US010869139B2

(12) United States Patent
Chiu et al.

(10) Patent No.: US 10,869,139 B2
(45) Date of Patent: Dec. 15, 2020

(54) HEARING AID DEVICE HAVING A MICROPHONE AND NECKBAND TO DETECT THE DIRECTION OF SOURCE OF SOUND

(71) Applicant: Merry Electronics(Shenzhen) Co., Ltd., ShenZhen (CN)

(72) Inventors: Kuan-Ling Chiu, Taichung (TW); Hung-Yue Chang, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 0 days.

(21) Appl. No.: 16/515,031

(22) Filed: Jul. 18, 2019

(65) Prior Publication Data

US 2020/0329317 A1 Oct. 15, 2020

(30) Foreign Application Priority Data

Apr. 15, 2019 (TW) ..... 108113096 A

(51) Int. Cl.
*H04R 25/00* (2006.01)

(52) U.S. Cl.
CPC ..... *H04R 25/405* (2013.01)

(58) Field of Classification Search
CPC ... H04R 1/02; H04R 1/04; H04R 1/20; H04R 1/22; H04R 1/222; H04R 1/227; H04R 1/24; H04R 1/245; H04R 1/26; H04R 1/265; H04R 1/32; H04R 1/326; H04R 1/40; H04R 25/00; H04R 25/04; H04R 25/40; H04R 25/402; H04R 25/405; H04R 25/407; H04R 25/55; H04R 25/554; H04R 2201/02; H04R 2201/023; H04R 2201/029; H04R 2201/10; H04R 2201/107
See application file for complete search history.

(56) References Cited

U.S. PATENT DOCUMENTS

| | | | | |
|---|---|---|---|---|
| 2003/0072461 | A1* | 4/2003 | Moorer | H04R 3/005 381/92 |
| 2019/0028817 | A1* | 1/2019 | Gabai | H04N 5/23238 |
| 2019/0174237 | A1* | 6/2019 | Lunner | G06F 3/011 |
| 2019/0246218 | A1* | 8/2019 | Hertzberg | G06F 3/012 |
| 2020/0100025 | A1* | 3/2020 | Shumard | H04R 3/005 |

* cited by examiner

*Primary Examiner* — Walter F Briney, III
(74) *Attorney, Agent, or Firm* — JCIPRNET

(57) ABSTRACT

A hearing aid device is provided. The hearing aid device at least includes a neckband and a first microphone. The neckband is worn on a neck of a user. The neckband defines a virtual datum plane and a first virtual plane parallel to each other, wherein the virtual datum plane overlaps a coronal plane of the user when the neckband is worn by the user, and a skin portion, furthest from the virtual datum plane, of a throat of the user is located on the first virtual plane. The first virtual plane is distant from the virtual datum plane by the first distance. The first microphone is disposed on the neckband, and is distant from the virtual datum plane by the second distance, wherein the second distance is less than the first distance.

9 Claims, 5 Drawing Sheets

HEARING AID DEVICE HAVING A MICROPHONE AND NECKBAND TO DETECT THE DIRECTION OF SOURCE OF SOUND

CROSS-REFERENCE TO RELATED APPLICATION

This application claims the priority benefit of Taiwan application serial no. 108113096, filed on Apr. 15, 2019. The entirety of the above-mentioned patent application is hereby incorporated by reference herein and made a part of this specification.

BACKGROUND

Technical Field

The disclosure relates to a hearing aid technology, more particularly relates to a hearing aid device.

Description of Related Art

Degeneration or damage in hearing ability often cause a problem that the hearing impaired fails to correctly recognize the sound, so the hearing impaired cannot immediately respond to the sound. Generally, the hearing impaired needs to use a hearing aid device to improve hearing ability. In order to allow the user to correctly recognize the direction of the source of the sound, the hearing aid device needs being worn on the user's ear, so that the sound signal received by the hearing aid device is similar to the sound signal directly received by human ear.

Accordingly, how to design a hearing aid device allowing the user to correctly recognize the direction of the source of the sound is one of the goals of people in the field.

SUMMARY

The disclosure provides a hearing aid device. The hearing aid device at least includes a neckband and a first microphone. The neckband is worn on the neck of a user. The neckband defines a virtual datum plane and a first virtual plane parallel to each other, wherein the virtual datum plane overlaps a coronal plane of the user when the neckband is worn by the user, and a skin portion, furthest from the virtual datum plane, of a throat of the user is located on the first virtual plane. The first virtual plane is distant from the virtual datum plane by the first distance. The first microphone is disposed on the neckband, and is distant from the virtual datum plane by the second distance, wherein the second distance is less than the first distance.

Based on the above, in the hearing aid device of the disclosure, the microphone is disposed at the specific location on the neckband, so that the sound signal received by the microphone is similar to the sound signal directly received by human ear.

In order to make the aforementioned and other features and advantages of the disclosure more comprehensible, embodiments accompanying figures are described in detail belows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
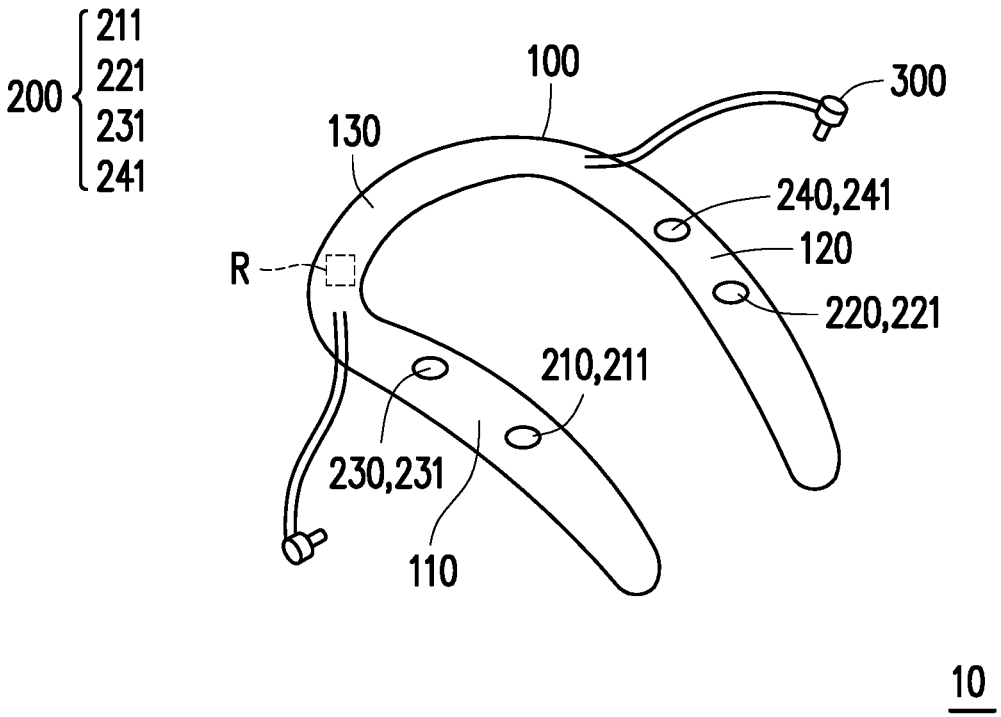
FIG. 1A is schematic view of a hearing aid device according to one embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

In the following detailed description of the preferred embodiment, reference is made to the accompanying drawings which form a part hereof, and in which are shown by way of illustration specific embodiment in which the invention may be practiced. In this regard, the directional terminologies, such as "top", "bottom", "left", "right", "front", or "back", etc., are used with reference to the orientation of the Figure(s) being described. Accordingly, the drawings and descriptions will be regarded as illustrative in nature and not as restrictive. In the following embodiments, the same reference numbers are used in the drawings and the description to refer to the same or similar elements.

The sound signal must be received by the microphone of the hearing aid device and is then converted by using the head-related transfer function (HRTF), so the output sound signal generated by the hearing aid device is similar to the sound signal directly heard by human ear from the sound source. The disclosure provides a hearing aid device having a microphone that is designed to be worn near the neck of the user, and the frequency response of the microphone can be substantially similar to the standard frequency response corresponding to the head-related transfer function. It should be noted here, the degree of similarity between the frequency responses can be calculated by any conventional statistical method and is not limited in the disclosure.

FIG. 1A is schematic view of a hearing aid device according to one embodiment of the disclosure. A hearing aid device 10 at least includes a neckband 100 and a first microphone 211 disposed in the neckband 100.

The directionality pattern on polar pattern of the first microphone 211 is, for example, omnidirectional, but the disclosure is not limited thereto. For example, the directionality pattern of the first microphone 211 may also be one of cardioid, hypercardioid, shotgun, or bi-directional.

Figure 2A:
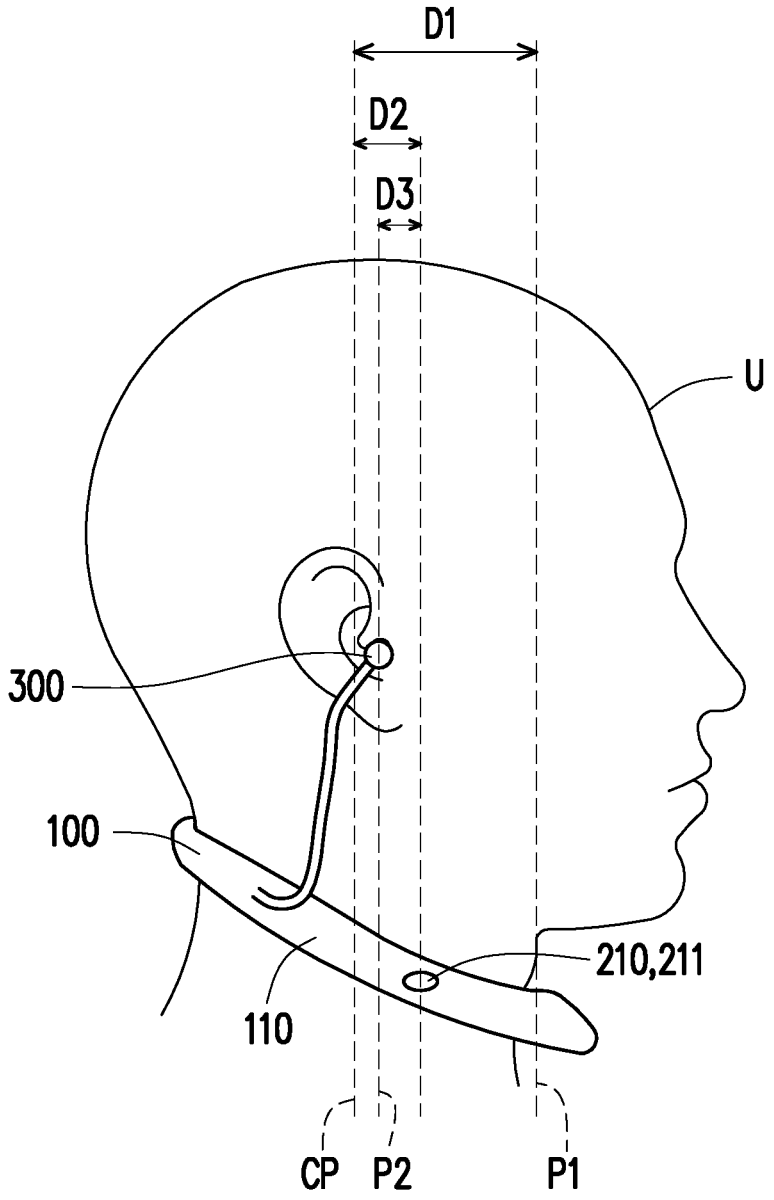
FIG. 2A is schematic view of relative position of the user and a hearing aid device according to one embodiment of the disclosure.

The neckband of the disclosure has an annular shape defining a left portion 120, a right portion 110, and a rear portion 130 connecting the left portion 120 with the right portion 110. The neckband 100 is provided for the user can wear on the neck. The neckband 100 defines a virtual datum plane CP and the first virtual plane P1, as shown in FIG. 2A. FIG. 2A is schematic view of relative position of the user U and the hearing aid device 10 according to one embodiment of the disclosure. When the user wears the hearing aid device 10, the virtual datum plane CP overlaps the coronal plane of the user U. The virtual datum plane CP passes through the left portion 120 and the right portion 110 of the neckband 100 and extends outwardly.

Referring to FIG. 1A and FIG. 2A, the hearing aid device 10 includes the first slot 210. The first slot 210 may be disposed at the right portion 110 (or the left portion 120, the disclosure is not limited thereto) of the neckband 100, and the first microphone 211 may be disposed in the first slot 210. The first microphone 211 (or the first slot 210) is distant from the virtual datum plane CP by the second distance D2. The first microphone 211 (or the first slot 210) is located on the ventral side, instead of the dorsal side, of the coronal plane (which overlaps with the virtual datum plane CP) of the user U.

On the other hand, a skin portion, which is furthest from the virtual datum plane CP, of the throat of the user is located on the first virtual plane P1, and the first virtual plane P1 is distant from the virtual datum plane CP by the first distance D1. The first virtual plane P1 is located on the ventral side, instead of the dorsal side, of the coronal plane (which overlaps with the virtual datum plane CP) of the user U, and the second distance D2 is less than the first distance D1. In other words, the first microphone 211 is disposed between the virtual datum plane CP and the first virtual plane P1. Accordingly, when the user U wears the hearing aid device 10, the sound signal from the left of the user U is not directly received by the first microphone 211 disposed in the right portion 110 of the neckband 100. The sound signal is first blocked by the throat of the user U, and is propagated to the position of the first microphone 211 after being diffracted.

The neckband 100 defines a second virtual plane P2 parallel to the virtual datum plane CP. When the user U wears the neckband 100, the left ear and the right ear of the user U are located on the second virtual plane P2, and the second virtual plane P2 is located on the ventral side, instead of the dorsal side, of the coronal plane (which overlaps with the virtual datum plane CP) of the user U. Specifically, when the user U wears the neckband 100, the cavum conchas of the left ear and the right ear of the user U are located on the second virtual plane P2. The second virtual plane P2 is distant from the first microphone 211 by the third distance D3. In order to make the frequency response of the first microphone 211 approximate to the standard frequency response corresponding to the head-related transfer function, the length the third distance D3 must be appropriately adjusted in accordance with the direction of the sound receiving port of the first microphone 211 (or the first slot 210).

Figure 2B:
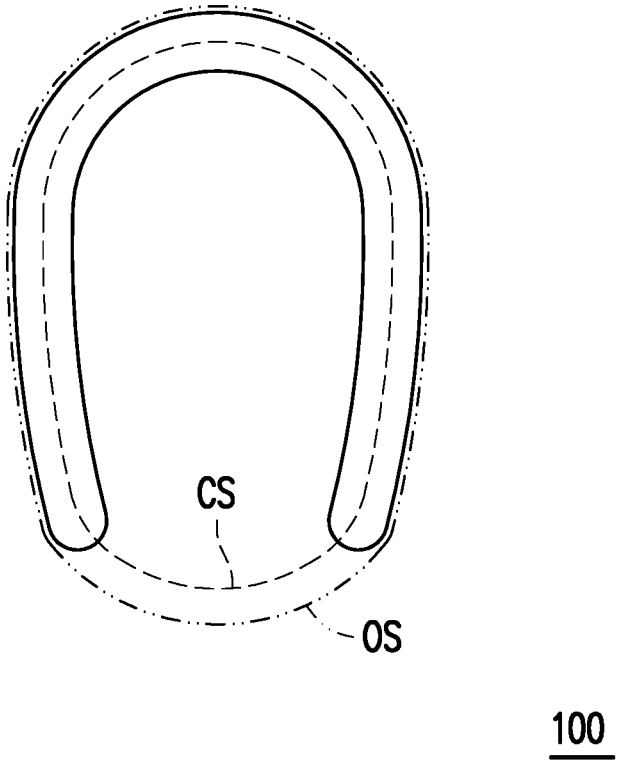
FIG. 2B is a schematic top view of a neckband according to one embodiment of the disclosure.

FIG. 2B is a schematic top view of the neckband according to one embodiment of the disclosure. The neckband 100 defines an upper edge surface CS and an outer edge side surface OS. The upper edge surface CS is a curved surface, which is closest to the top of the head of the user U, in a plurality of curved surfaces constructed by the neckband 100. The outer edge side surface OS is the largest curved surface constructed by the neckband 100. Referring to FIG. 2B, the sound receiving port of the first microphone 211 may have multiple different configurations.

In one embodiment, the sound receiving port of the first microphone 211 faces the upper edge surface CS. In this configuration, the third distance D3 between the second virtual plane P2 and the first microphone 211 is designed to be from 0.5 centimeters to 1.5 centimeters.

In one embodiment, the sound receiving port of the first microphone 211 faces the outer edge side surface OS. In this configuration, the third distance D3 between the second virtual plane P2 and the first microphone 211 is designed to be from 2.5 centimeters to 3.5 centimeters.

Figure 3:
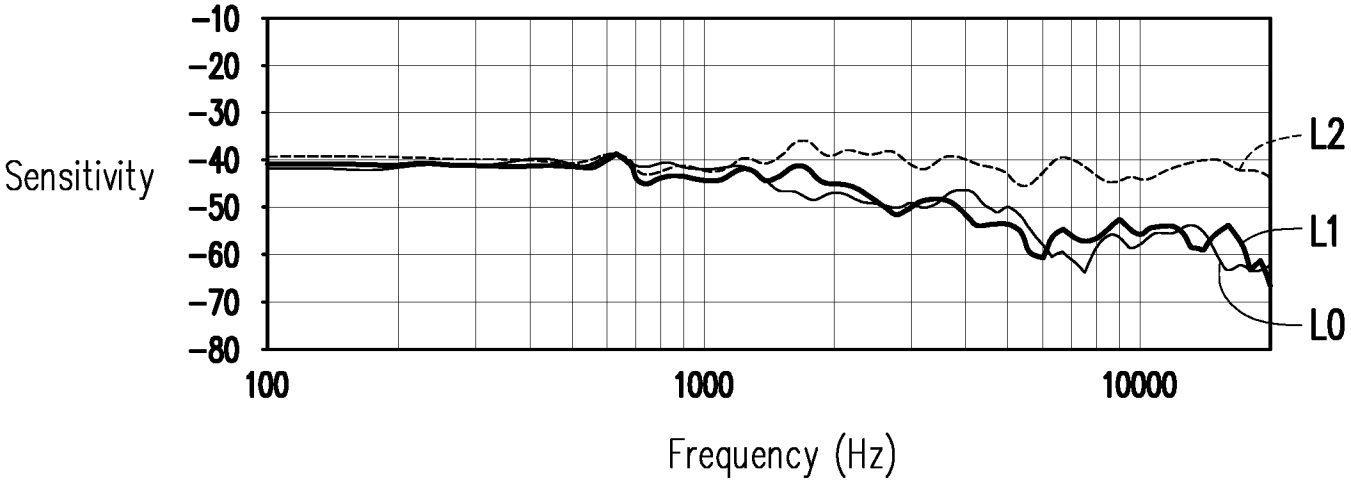
FIG. 3 is a diagram showing frequency response related to the head-related transfer function according to one embodiment of the disclosure.

The frequency response of the first microphone 211 approximates to the standard frequency response corresponding to the head-related transfer function. Referring to FIG. 3, in case that the sound receiving port of the first microphone 211 faces the outer edge side surface OS and the third distance D3 between the second virtual plane P2 and the first microphone 211 is designed as 3 centimeters, the frequency response curve L1 corresponding to the sensitivity (unit: dB re 1 V/Pa) of the first microphone 211 approximates to the standard frequency response curve L0 corresponding to the head-related transfer function. In case that a microphone is not configured as mentioned in the disclosure, the frequency response curve of that microphone may be similar to the frequency response curve L2 and thus cannot accurately simulate the standard frequency response curve L0.

Figure 1B:
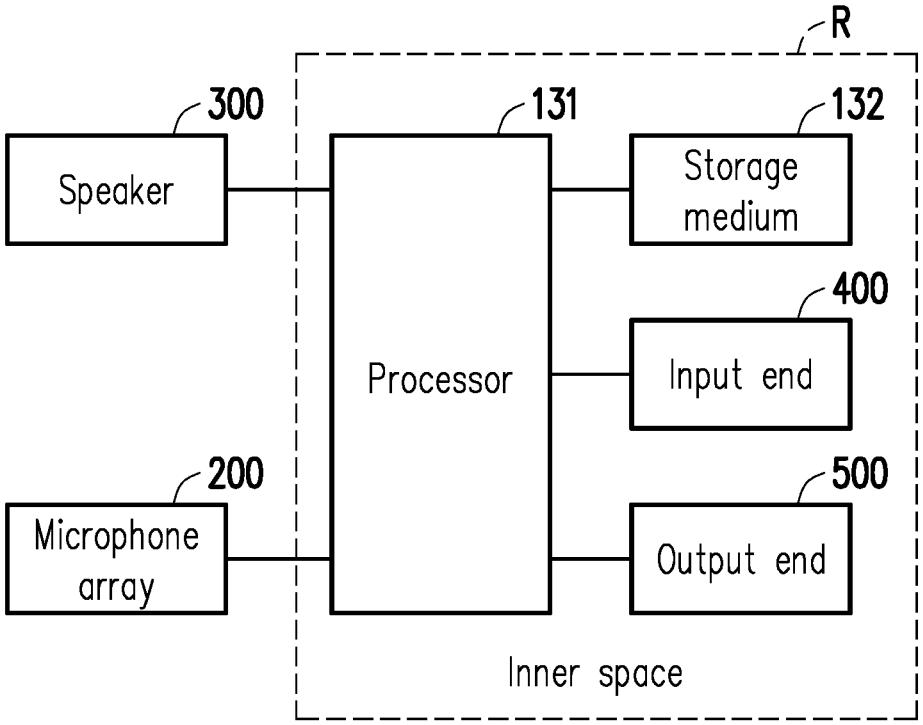
FIG. 1B is a block diagram of a hearing aid device according to one embodiment of the disclosure.

In one embodiment, a plurality of microphones may be disposed in the neckband 100. Referring to FIG. 1A and FIG. 1B, the second microphone 221 coupled to the processor 131 may be disposed in the second slot 220 of the left portion 120 of the neckband 100, and the first microphone 211 and the second microphone 221 may be disposed in the neckband 100 in a symmetrical manner. On the other hand, the neckband 100 may be configured with a microphone array 200 constituted by a plurality of microphones. For example, the neckband 100 may be configured with the microphone array 200 constituted by the first microphone 211, the second microphone 221, the third microphone 231 (which may be disposed in the third slot 230), and the fourth microphone 241 (which may be disposed in the fourth slot 240). It should be noted here, the number of the microphones in the microphone array 200 can be adjusted according to design requirements, and the disclosure is not limited thereto.

In one embodiment, the hearing aid device 10 further includes a processor 131 and a storage medium 132. The processor 131 and the storage medium 132 may be disposed in the inner space R of the neckband 100. In FIG. 1A, the inner space R is disposed at the rear portion 130 of the neckband 100, but the disclosure is not limited thereto. For example, the inner space R may also be disposed at the right portion 110 or the left portion 120 of the neckband 100.

The controller 131 is, for example, a central processing unit (CPU), a microprocessor programmed for general purpose or special purpose, a digital signal processor (DSP), a programmable controller, an application specific integrated circuits (ASIC), graphics processing unit (GPU), combination thereof, or other similar devices.

The storage medium 132 is, for example, any type of fixed or removable random access memory (RAM), read-only memory (ROM), flash memory, hard disk drive (HDD), solid state drive (SSD), combination thereof, or other similar devices.

Figure 4A:
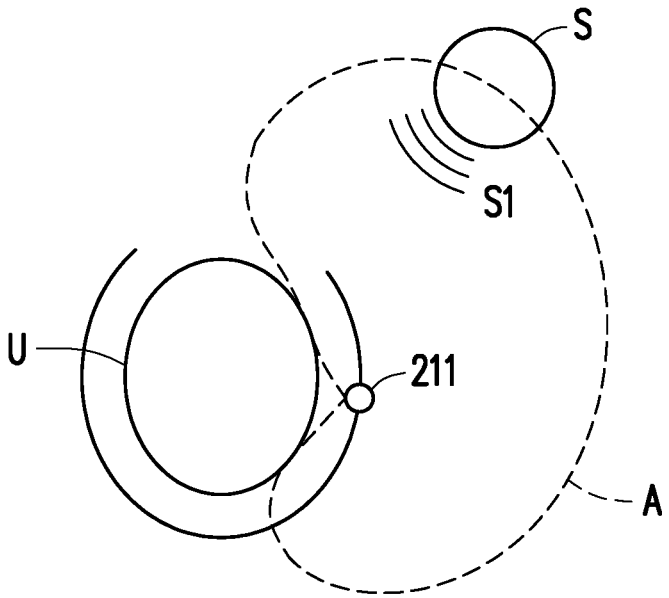
FIG. 4A is schematic view of the directionality pattern of the first microphone according to one embodiment of the disclosure.

The storage medium 132 stores the head-related transfer function. The processor 131 is coupled to the storage medium 132 and can be coupled to the first microphone 211 or any microphone in the microphone array 200 (such as the microphone 211, 221, 231, or 241). After the first microphone 211 or the microphone array 200 receives the sound signal, the processor 131 converts the sound signal to a sound signal corresponding to the ear of the user through the head-related transfer function stored in the storage medium 132. FIG. 4A is schematic view of the directionality pattern of the first microphone 211 according to one embodiment of the disclosure. Referring to FIG. 1B and FIG. 4, after the first microphone 211 receives the first sound signal 51 from a source S through an omnidirectional sound receiving field A, the processor 131 converts the first sound signal 51 to the second sound signal corresponding to the ear position of the user U through the head-related transfer function. In comparison with the first sound signal 51 which is not processed, the second sound signal, which is obtained through conversion using the head-related transfer function, approximates to the sound signal directly heard from the source S by human ear.

The second sound signal can be output to the ear of the user U through different output components. Referring to FIG. 1A and FIG. 1B, in one embodiment, the hearing aid device 10 further includes a speaker 300, and the speaker 300 is coupled to the processor 131. After the processor 131 generates the second sound signal by using the head-related transfer function, the processor 131 can output the second sound signal through the speaker 300. In another embodiment, the hearing aid device 10 further includes an output end 500. The output end 500 is, for example, a TRS connector, a universal serial bus (USB), or communication interface in communication technology, such as Bluetooth, etc. The output end 500 is coupled to the processor 131 and may be connected to the earphone (or speaker). After the processor 131 generates the second sound signal according to the head-related transfer function, the processor 131 can output the second sound signal through the output end 500 and the earphone.

Generally, the hearing impaired is more accustomed to a quiet environment. If the hearing impaired has a conversation with another person in a noisy environment, that hearing-impaired person may be easily distracted by the noise of the surrounding environment.

In view of the above, the hearing aid device 10 of the disclosure can generate a directional sound receiving wave beam by a plurality of microphones, thereby filtering out the sound signals unrelated to the user.

Figure 4B:
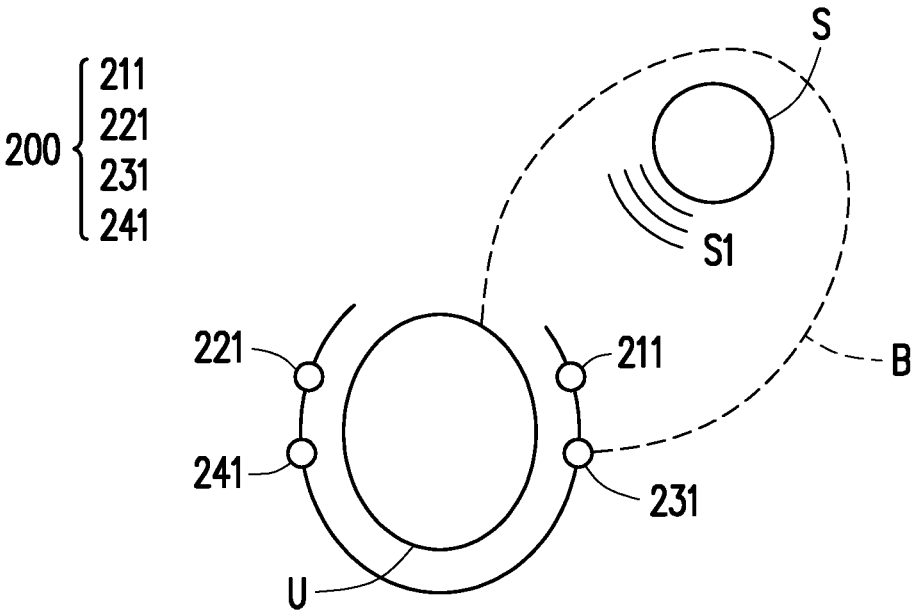
FIG. 4B is schematic view of a sound receiving wave beam of a microphone array according to one embodiment of the disclosure.

FIG. 4B is schematic view of a sound receiving wave beam of the microphone array 200 according to one embodiment of the disclosure. Referring to FIG. 1B and FIG. 4B, in one embodiment, the processor 131 of the hearing aid device 10 can be used to determine the direction of the first sound signal S1 from the source S. For example, the processor 131 can determine the direction of the first sound signal S1 from the source S according to intensity of the first sound signal S1 received by each and every microphone in the microphone array 200. After determining the direction that the source S is located, the hearing aid device 10 can control each of the microphones (such as the microphones 211, 221, 231, and 241) in the microphone array 200 to be enabled or disabled according to the source S, thereby forming the sound receiving wave beam B directed to the source S.

In another embodiment, the hearing aid device 10 further includes an input end 400 coupled to the processor 131. The input end 400 is, for example, a universal serial bus (USB), or communication interface in communication technology, such as Bluetooth, etc. In addition, the input end 400 can receive a control command from an external device, which is a mobile device with computing functions, such as a smart phone, etc., as an example. The control command can be used to instruct the hearing aid device 10 to form the sound receiving wave beam B directed/oriented to a specific direction. For example, the user U can use the smartphone and the input end 400 to input the control command related to the direction of the source S into the processor 131. Next, processor 131 can control each of the microphones (such as the microphones 211, 221, 231, and 241) in the microphone array 200 to be enabled or disabled according to the control command, thereby forming the sound receiving wave beam B directed to the source S.

Summarily, in the hearing aid device of the disclosure, the microphone is disposed at the specific location on the neckband, the microphone is shielded by the neck of the user, so that the sound signal must be diffracted before being received by the microphone. In the diffraction process, the sound signal is delayed, so the sound signal received by the microphone has a sense of direction and is similar to the sound signal directly received by human ear. In addition, the components having weights, such as the processor, the storage medium, and the microphone can be disposed into the inner space of the neckband. Therefore, the ear of the user does not bear an excessive weight. Accordingly, in comparison with the conventional hearing aid device, not only is the hearing aid device of the disclosure more beautiful, the hearing aid device also reduces the user's discomfort.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A hearing aid device, comprising:

a neckband, being worn on a neck of a user, the neckband defining a virtual datum plane and a first virtual plane parallel to each other, wherein when the neckband is worn by the user, the virtual datum plane overlaps a coronal plane of the user, and a skin portion furthest from the virtual datum plane of a throat of the user is located on the first virtual plane, and the first virtual plane is distant from the virtual datum plane by a first distance; and a first microphone, disposed on the neckband, and being distant from the virtual datum plane by a second distance, wherein the second distance is less than the first distance, wherein the neckband defines an upper edge and an outer edge side surface, and a sound receiving port of the first microphone faces the upper edge side surface, wherein the neckband defines a second virtual plane parallel to the virtual datum plane, when the user wears the neckband, a left ear and a right ear of the user are located on the second virtual plane, and a distance between the second virtual plane and the first microphone if from 0.5 centimeters to 1.5 centimeters, so that a frequency response of the first microphone approximates to a standard frequency response corresponding to a head-related transfer function, the hearing aid device further comprising:

a storage medium, disposed in an inner space of the neckband and storing the head-related transfer function; and a processor, disposed in the inner space of the neckband, and coupled to the storage medium and the first microphone, wherein the processor converts a first sound signal received by the first microphone to a second sound signal corresponding to an ear position of the user through the head-related transfer function, wherein the inner space of the neckband is disposed at a rear portion of the neckband.

2. The hearing aid device as recited in claim 1, wherein the neckband has an annular shape defining a left portion, a right portion, and the rear portion connecting the left portion with the right portion, and the virtual datum plane passes through the left portion and the right portion of the neckband and extends outwardly.

3. The hearing aid device as recited in claim 2, wherein at least one of the left portion and the right portion is configured to have a first slot, and the first microphone is disposed in the first slot.

4. The hearing aid device as recited in claim 1, further comprising:

a second microphone, wherein the first microphone and the second microphone are disposed in the neckband in a symmetrical manner.

5. The hearing aid device as recited in claim 1, further comprising a microphone array, wherein the microphone array comprises the first microphone and at least one second microphone.

6. The hearing aid device as recited in claim 5, further comprising:

the processor, coupled to the microphone array, wherein the processor is configured to determine a source of the first sound signal and to control one or more microphones in the microphone array to be enabled or disabled according to the source, so as to form a sound receiving wave beam directed to the source.

7. The hearing aid device as recited in claim 5, further comprising:

an input end, receiving a control command; and the processor, coupled to the input end and the microphone array, wherein the processor is configured to control one or more microphones in the microphone array to be enabled or disabled according to the control command, so as to form a sound receiving wave beam corresponding to the control command.

8. The hearing aid device as recited in claim 1, wherein the first microphone is an omni-directional microphone.

9. A hearing aid device, comprising:

a neckband, being worn on a neck of a user, the neckband defining a virtual datum plane and a first virtual plane parallel to each other, wherein when the neckband is worn by the user, the virtual datum plane overlaps a coronal plane of the user, and a skin portion furthest from the virtual datum plane of a throat of the user is located on the first virtual plane, and the first virtual plane is distant from the virtual datum plane by a first distance; and a first microphone, disposed on the neckband, and being distant from the virtual datum plane by a second distance, wherein the second distance is less than the first distance, wherein the neckband defines an upper edge surface and an outer edge side surface, and a sound receiving port of the first microphone faces the outer edge side surface, wherein the neckband defines a second virtual plane parallel to the virtual datum plane, when the user wears the neckband, a left ear and a right ear of the user are located on the second virtual plane, and a distance between the second virtual plane and the first microphone if from 2.5 centimeters to 3.5 centimeters, so that a frequency response of the first microphone approximates to a standard frequency response corresponding to a head-related transfer function, the hearing aid device further comprising:

a storage medium, disposed in an inner space of the neckband and storing the head-related transfer function; and a processor, disposed in the inner space of the neckband, and coupled to the storage medium and the first microphone, wherein the processor converts a first sound signal received by the first microphone to a second sound signal corresponding to an ear position of the user through the head-related transfer function, wherein the inner space of the neckband is disposed at a rear portion of the neckband.

* * * * *